United States Patent [19]

Heren

[11] Patent Number: 4,776,517

[45] Date of Patent: Oct. 11, 1988

[54] PISTOL GRIP HOSE NOZZLE

[75] Inventor: Lawrence P. Heren, Peoria, Ill.

[73] Assignee: L. R. Nelson Corporation, Peoria, Ill.

[21] Appl. No.: 877,461

[22] Filed: Jun. 23, 1986

[51] Int. Cl.[4] ..... A62C 31/02

[52] U.S. Cl. ..... 239/391; 239/526

[58] Field of Search ..... 239/525, 526, 390, 391, 239/397; D91/1; 251/229

[56] References Cited

U.S. PATENT DOCUMENTS

| | | | |
|---|---|---|---|
| D. 148,892 | 4/1950 | Swimmer | D91/1 |
| D. 194,014 | 11/1962 | Gilmour | D91/1 |
| 1,430,533 | 10/1922 | Brown . | |
| 1,631,167 | 6/1927 | Tereau . | |
| 1,825,864 | 10/1931 | Harter . | |
| 2,343,647 | 3/1944 | Doerr . | |
| 2,523,084 | 9/1950 | Adragna . | |
| 2,567,176 | 9/1951 | Ballard | 239/526 |
| 2,657,098 | 10/1953 | Strahman . | |
| 2,792,260 | 5/1957 | Wood . | |
| 2,844,408 | 7/1958 | Dickmann et al. . | |
| 2,852,310 | 9/1958 | Francis . | |
| 2,883,117 | 4/1959 | Nelson | 239/459 |
| 2,937,813 | 5/1960 | Rinkewich | 239/583 |
| 3,006,560 | 10/1961 | Rosenkranz | 239/456 |
| 3,799,447 | 3/1974 | Beal | 239/526 X |
| 4,083,497 | 4/1978 | Rosenberger | 239/526 |
| 4,534,512 | 3/1983 | Chow et al. | 239/526 X |

OTHER PUBLICATIONS

"Unijet Nozzles", Spraying Systems Co., 9-5-79.

*Primary Examiner*—Kenneth J. Dorner
*Assistant Examiner*—Gerald A. Anderson
*Attorney, Agent, or Firm*—Cushman, Darby and Cushman

[57] ABSTRACT

A pistol hose nozzle including a handle structure and a barrel structure extending forwardly from the upper end thereof. The handle and barrel structures are formed of two outer shell parts enclosing an inner conduit providing a water flow path between an inlet at the lower end of the handle structure and an outlet at the forward end of the barrel structure. A spring actuated on-off valve mechanism is disposed within the handle portion of the flow path and a fixed orifice is disposed within the barrel portion of the flow path. A variable leverage mechanism serves to transmit the movement of a finger trigger to the valve mecahnism. A thumb actuated mechanism is provided for selectively retaining the trigger in its operating position. Coupling means is provided in the forward end of the barrel structure and rearward tubular portions of an adjustable spray assembly and a rotary outlet assembly for enabling either to be detachably interengaged therewith.

36 Claims, 6 Drawing Sheets

PISTOL GRIP HOSE NOZZLE

This invention relates to hose nozzles and more particularly to hose nozzles of the pistol grip or gun type.

Pistol grip or gun type hose nozzles have been a popular commercial item for some years. U.S. Pat. No. Des. 148,892 discloses one of the earliest commercially popular units. U.S. Pat. No. Des. 194,014 discloses a popular second generation pistol grip hose nozzle of this type.

Both of the pistol grip hose nozzles shown in the above mentioned patents consist essentially of a cast metal body having a handle portion and a barrel portion extending forwardly from the upper end of the handle portion. Formed in the lower end of the handle portion is a female hose fitting. A nozzle is threaded over the forward end of the barrel portion and serves to retain in the forward interior end of the barrel portion a resilient washer providing a rearwardly facing annular valve seat. Slidably mounted within the barrel portion is a valve member including an annular shutoff valve element operable to engage the washer, a spray modifying element extending forwardly therefrom through the orifice of the nozzle, and a valve stem extending rearwardly from the valve element and outwardly through the rear end of the barrel portion. A coil spring is disposed in surrounding relation to the valve stem so as to resiliently urge the valve element forwardly into a valve closing position. The valve stem extends exteriorly of the rear end of the barrel portion through a seal assembly and its exposed rearward end is threaded to receive an adjusting nut which engages the upper lever arm of an actuating lever pivoted to the handle portion. A lower larger manually engagable lever arm is disposed in generally parallel relation rearwardly of the handle portion. A pivoted bail serves to retain the actuating lever in any position of actuation. These hose nozzles have been identified commercially as pistol grip nozzles despite the fact that the actuator for the nozzle consists of a lever arm disposed rearwardly of the handle and engagable with the palm of the user's hand rather than a one-finger actuated trigger disposed forwardly of the handle as is the case with a traditional pistol configuration.

Even prior to the commercial popularity of pistol grip hose nozzles, the patented literature contained proposals for constructing hose nozzles more nearly like a pistol than those which actually later became popular. Reference is made here to U.S. Pat. Nos. 1,430,533, 1,631,167 and 1,825,864. Moreover, the patented literature contains many disclosures of modification to the conventional pistol grip nozzle which would place the actuating lever in a position more closely simulating the position of the trigger in a pistol, that is, forwardly of the handle rather than rearwardly thereof. Reference is here made to U.S. Pat. Nos. 2,523,084, 2,792,260, 2,844,408, 2,852,310 and 2,883,117.

The later patented literature contains one disclosure of a proposed hose nozzle which closely simulates a pistol and includes a trigger member of the type adapted to be operated by a single finger. As far as applicant is aware, the digital trigger actuated nozzle disclosed in U. S. Pat. No. 3,006,560 like the digital trigger actuated nozzles of the early prior art have not received any significant acceptance on the commercial market.

One problem which is presented by the provision of a single digital trigger member as distinguished from a hand lever type actuating member is that it is much more difficult for the user to apply a relatively high actuating force to the trigger member by a single finger than it is by an entire hand grip. Consequently, when dealing with a single digitally operated trigger member the force required is much more critical than in a lever-type actuator. The force required to move the trigger is a function of the increasing spring force resisting such movement and the manner of transmittal of such force by the motion transmitting mechanism to the spring pressed valve member. Accordingly, an acceptable pistol grip nozzle which provides for single digital actuation must effectively deal with and overcome this problem.

It is an object of the present invention to provide a hose nozzle having a single digital trigger actuating member which effectively overcomes the increased force requirements problem noted above. In accordance with the principles of the present invention, this objective is accomplished by providing a hose nozzle which includes a trigger member disposed below the barrel structure and forwardly of the handle structure and mounted for digital movement from an inoperative position into an operative position and a variable leverage motion transmitting mechanism for causing a digital movement of the trigger member from its inoperative position into its operative position to move the valve member from its valve closing position into its valve opening position against the increasing bias of the valve spring with a digital force which varies from an initial force required to move the trigger member away from its inoperative position to a final force required to move the trigger member into its operative position. The final force to initial force ratio of the trigger member movement being substantially less than the final force to initial force ratio of the valve member movement so as to compensate for the increasing spring force and enable the digital force requirements of the user to remain confortable throughout the range of movement of the valve member.

The gun simulating hose nozzle disclosed in U.S. Pat. No. 3,006,560 includes a main casting which provides the major exterior design of the gun configuration while at the same time providing for the interior flow path of water therethrough from the lower end of the handle portion to the forward end of the barrel portion. In order to accomplish both of these functions and to provide for a digitally actuated trigger a particular arrangement for allowing the trigger to be inserted rearwardly into operative position is provided. While the main casting provides a substantial portion of the exterior design, the exterior design of the sides of the handle is provided by a pair of plastic overlay elements suitably fixed to the main casting. These plastic overlay elements would inherently provide some insulating effect so that when liquids having an uncomfortable temperature flow through the nozzle, such uncomfortable temperature would not be transmitted or conducted fully to the users hand as would be the case conventionally where the hand grip portion is formed entirely as a simple tubular metal casting. It is known to provide an outer plastic cover for a conventional type pistol grip nozzle not only for insulating purposes so as to render the handle grip more comfortable to the user but for protective purposes of the entire nozzle itself. Such a disclosure is contained in U.S. Pat. No. 2,657,098. An insulating protective structure in the form of two plastic elements which are mounted in overlying relation to the handle portion of a conventional pistol grip nozzle is disclosed in U.S. Pat. No. 3,799,447. As shown, the elements extend upward slightly over the adjacent barrel portion of the conventional nozzle.

In all of these prior art devices where additional exterior components have been added to a main casting, the exterior configuration of the main casting still importantly enters into the design characteristics of the hose nozzle. Indeed, precise simulation of any desired pistol configuration cannot be utilized because the utilitarian aspects of the main casting dictate to a considerable extent what the exterior design must be like.

It is another object of the present invention to provide a hose nozzle in which the design restrictions heretofore imposed by the prior art are eliminated so as to enable the construction of the hose nozzle to be optimized both with respect to its utilitarian features as well as its design characteristics. In accordance with the principles of the present invention, this object is accomplished by providing a hose nozzle in which the handle and barrel structures are defined by an interior water handling conduit providing interior handle and barrel portions of the handle and barrel structures, respectively, and a plurality of cooperating exterior parts fixed together in surrounding relation to the interior water handling conduit so as to provide exterior handle and barrel portions of the handle and barrel structures, respectively. The exterior parts present a gun simulating exterior periphery, the handle portion of which is shaped to be gripped by a hand of the user. The exterior parts enclose (1) the inner conduit, (2) the valve member, and (3) the motion transmitting mechanism to an extent such that the gun simulating exterior periphery thereof together with the trigger member and the water outlet constitute substantially the entire visual appearance of the hose nozzle. Moreover, the exterior parts present an interior periphery disposed in spaced relation with respect to (1) the valve member, and (2) the motion transmitting mechanism to an extent sufficient to accomodate the movements thereof and (3) an extent of the exterior periphery of the handle portion of the inner conduit sufficient to define an insulating air space suitable to render the handle portion of the exterior periphery of the exterior parts more comfortable to grip when water at an uncomfortable temperature is flowing through the flow path provided by the conduit.

Pistol grip nozzles have to a considerable extent displaced the utilization of conventional barrel type nozzles which were in widespread use prior to the commercial popularity of pistol grip nozzles. A barrel type nozzle, (see, for example, U.S. Pat. No. 2,343,647) which has been available commercially for many years consists essentially of four parts. The first part includes the female hose fitting at its rearward end and a sweeper nozzle at its forward end. Swivelly mounted on the exterior of the first part adjacent the female fitting is an interiorly threaded sleeve. The other two parts include (1) a barrel member having a nozzle orifice at its forward end and an exterior thread at its rearward end for engaging the interior thread of the sleeve and (2) an inner spray defining element having a longitudinally slidable connection with the exterior forward end of the first member and an exterior threaded connection with respect to the central interior periphery of the barrel member. The arrangement is such that by removing the barrel member and the inner spray defining element, the remaining parts serve as a sweeper nozzle whereas when the barrel member and inner spray defining element are assembled therewith the hose nozzle provides conventional operation. While gun type nozzles have been commercially popular for well over thirty years, as far as applicant is aware there are no patents proposing pistol grip nozzle configurations providing a similar capability nor has such capability been available on the commercial market insofar as the pistol grip nozzle is concerned.

Accordingly, it is an object of the present invention to provide a pistol grip type hose nozzle construction which does embody the aforesaid capabilities heretofore embodied only in barrel type hose nozzles. In accordance with the principles of the present invention, this objective is achieved by providing a hose nozzle having a member in the water flow path at the forward barrel structure thereof defining a fixed orifice for directing water from the forward end of the barrel structure with a jet stream suitable for sweeping walks and the like. The valve member is mounted for movement between valve closing and valve opening positions at a position which is disposed upstream from the fixed orifice and an adjustable spray assembly is selectively detachably mountable on the barrel structure downstream of the fixed orifice in water receiving relation with respect to the water flowing from the fixed orifice for directing the water flowing therefrom in any selected one of a multiplicity of different spray streams so that the user may select as the water output of the hose nozzle either the jet stream flowing from the fixed orifice by detaching the adjustable spray assembly from the barrel structure or the selected spray stream flowing from the adjustable spray assembly by detachably mounting the latter on the barrel structure.

Another object of the present invention is the provision of a pistol grip hose nozzle of the type described having a series of different nozzle outlet assemblies and detachable interengaging coupling means on each of the nozzle assemblies and the barrel structure for enabling a user to detachably interconnect a selected one of the set of different nozzle outlet assemblies on the barrel structure in flow receiving relation to the water outlet therein so that water flowing from the water outlet will be caused to flow in a stream determined by the selected interconnected nozzle assembly.

Still another object of the present invention is the provision of a hose nozzle of the type described which is simple in construction, effective in operation and economical to manufacture.

These and other objects of the present invention will become more apparent during the course of the following detailed description and appended claims.

The invention may best be understood with reference to the accompanying drawings wherein an illustrative embodiment is shown.

IN THE DRAWINGS

Referring now more particularly to the drawings, there is shown in FIGS. 1–4 thereof a hose nozzle, generally indicated at 10, which embodies the principles of the present invention. As shown, the hose nozzle 10 embodies a handle structure, generally indicated at 12, and a barrel structure, generally indicated at 14, extending forwardly from the upper end of the handle structure 12. A conduit, generally indicated at 16, provides the interior configuration of both the handle structure 12 and the barrel structure 14. The exterior configuration of the handle structure 12 and the barrel structure 14 is provided by a pair of exterior cooperating parts 18 and 20.

Figure 3:
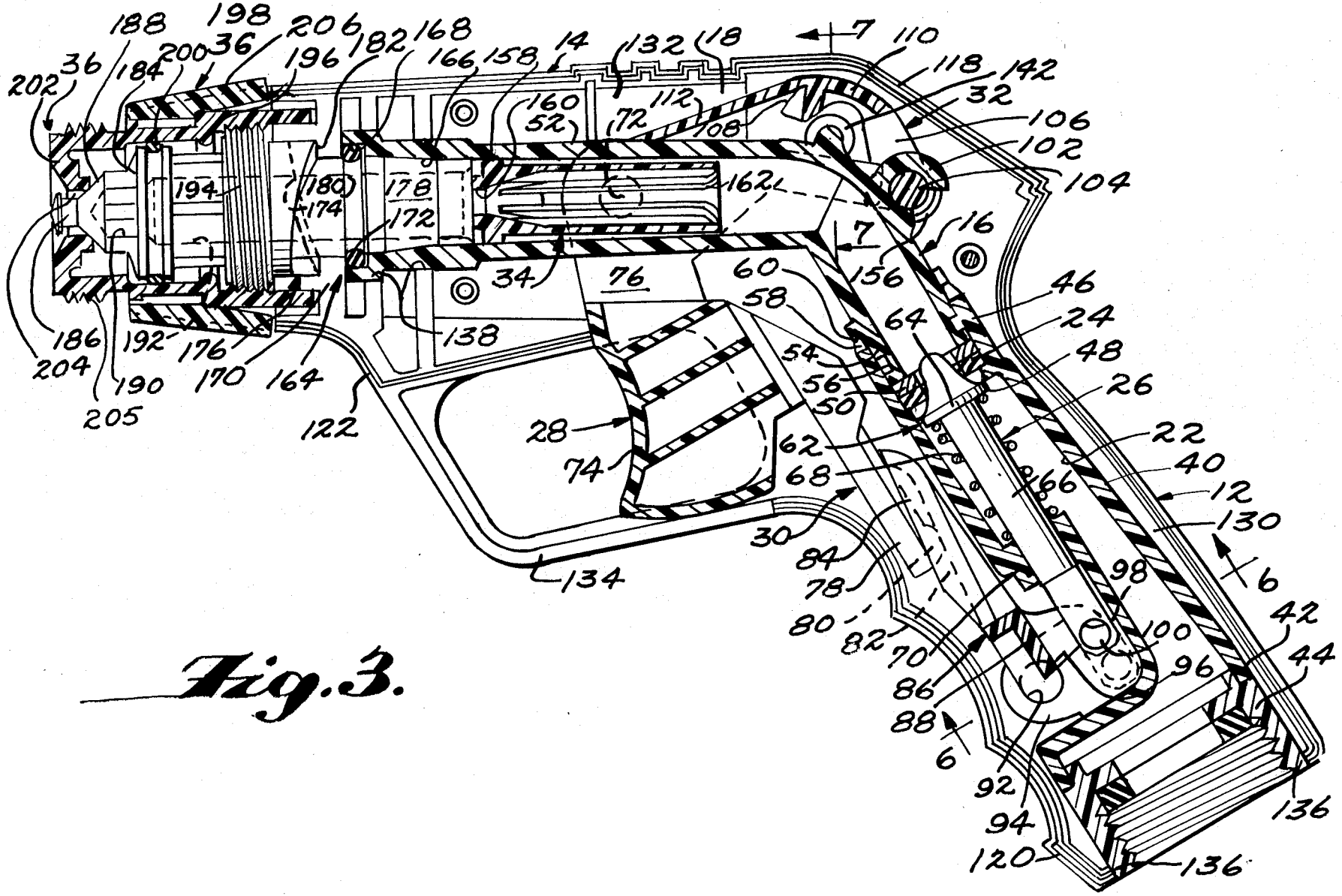
FIG. 3 is a vertical sectional view of the hose nozzle shown in FIG. 1 with the parts being illustrated in their inoperative position.
Figures 4, 5:
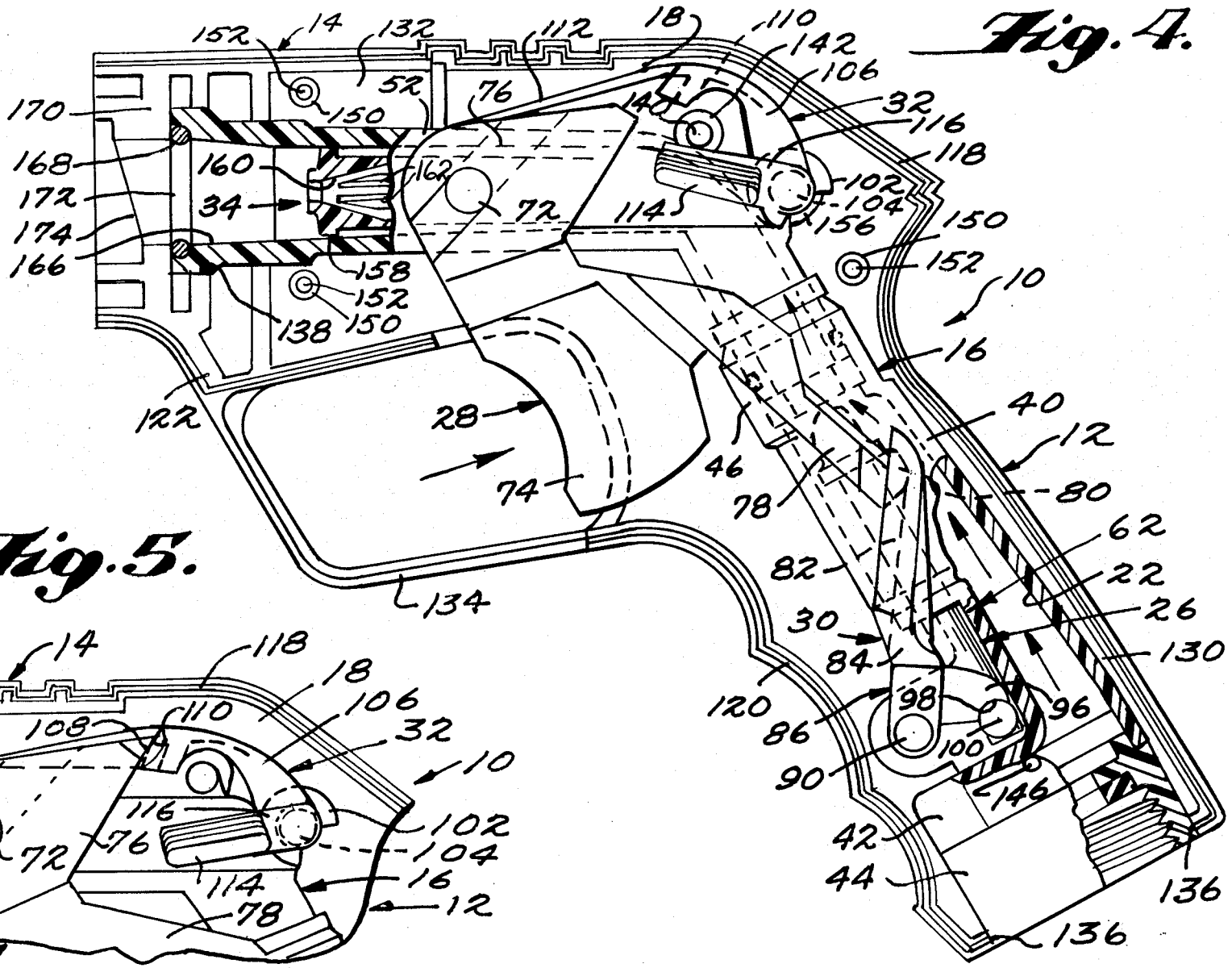
FIG. 4 is a side elevational view with the left-hand exterior part of the hose nozzle removed and the adjustable spray assembly likewise removed, the parts being shown in their operative position for directing a jet stream from the outlet of the hose nozzle.
FIG. 5 is a fragmentary view similar to FIG. 4 showing the trigger retaining mechanism in its trigger retaining position.
Figure 6:
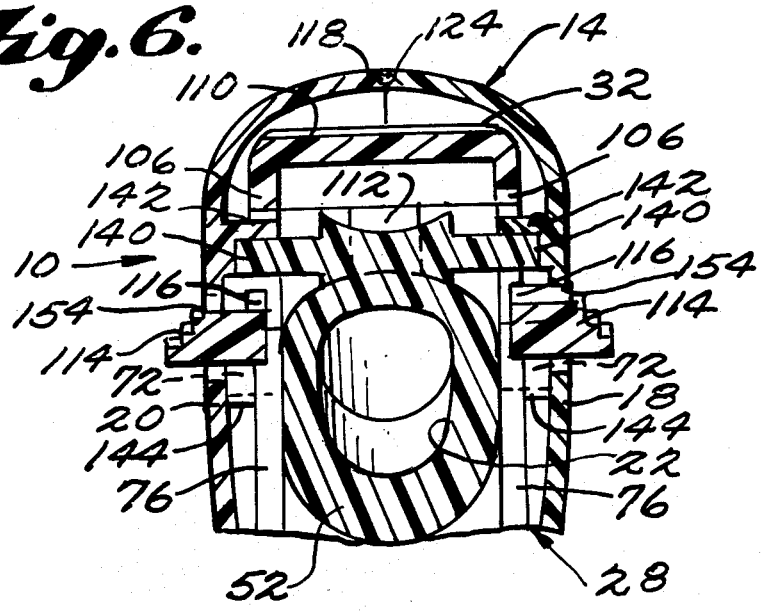
FIG. 6 is an enlarged fragmentary sectional view taken along the line 6—6 of FIG. 3.

The inner conduit 16 provides a water flow path 22 which extends from the lower end of the handle structure 12 as an inlet to the forward end of the barrel structure 14 as an outlet. Mounted within the flow path 22 between the inlet and outlet thereof is an annular resilient washer 24 which defines a downwardly facing annular valve seat. Mounted between valve opening and valve closing positions with respect to the valve seat 24 is a spring actuated valve mechanism, generally indicated at 26. The spring actuated valve mechanism 26 is moved between its valve opening and valve closing positions by a trigger member, generally indicated at 28, which is mounted in a position below the barrel structure 14 and forwardly of the handle structure 12 for movement between an inoperative position, as shown in FIG. 3, and an operative position, as shown in FIG. 4. A variable leverage motion transmitting mechanism, generally indicated at 30, serves to transmit a movement of the trigger member 28 from its inoperative position into its operative position into a movement of the valve mechanism 26 from its valve closing position into its valve opening position.

A trigger retaining mechanism, generally indicated at 32, is provided for selectively retaining the trigger member 28 in its operative position. Mounted in the water path 22 in a position downstream from the valve seat 24 adjacent the forward end of the barrel structure 14 is a jet stream orifice defining member, generally indicated at 34. While the hose nozzle 10 may be utilized with the fixed orifice member 34 defining the output of the water, the invention contemplates a series of nozzle outlet assemblies including an adjustable spray assembly, generally indicated at 36, shown in FIGS. 1 and 3, and a rotary nozzle outlet assembly, generally indicated at 38, shown in FIGS. 10 and 11.

The conduit 16 is preferably provided by a lower conduit part 40 which includes a lower annular wall 42. A separate female hose fitting 44 is fixedly mounted within the lower annular wall 42, as by sonic welding or the like. The upper end of the lower inner conduit part 40 is provided with a cylindrical wall 46. As best shown in FIG. 3, formed within the interior periphery of the cylindrical wall 46 at a position spaced from the upper extremity thereof is an annular shoulder 48 which serves to receive and position the resilient washer 24 so that the valve seat defined thereby is facing downwardly. As shown, a backing washer 50 is disposed in engagement with the forward or upward face of the washer 24.

The conduit 16 also includes an upper conduit part 52. The upper conduit part defines the entire inner barrel portion of the conduit 16 and an upper section of the inner handle portion thereof, the remainder of which is defined by the lower conduit part 40 and the female fitting 44. As shown, the upper conduit part 52 includes a lower cylindrical wall 54 of a size to engage within the upper cylindrical wall 46 of the lower conduit part 40. The exterior periphery of the cylindrical wall 54 is formed with a suitable annular groove for receiving an O-ring seal 56, the outer periphery of which sealingly engages the inner periphery of the upper cylindrical wall 46 of the lower conduit part 40. In addition, it will be noted that, as shown in FIG. 3, the lower extremity of the cylindrical wall 54 engages the upper facing surface of the backing washer 50. In this way, the backing washer 50 and resilient washer 24 are trapped between the shoulder 48 and the lower extremity or edge of the cylindrical wall 54. Any suitable means may be provided for retaining the two conduit parts 40 and 52 in fixed relation and, as best shown in FIG. 3, such means includes a plurality of annularly spaced tapered lugs 58 formed on the exterior periphery of the cylindrical wall 54 inwardly of the O-ring 56 and corresponding opening 60 extending through the cylindrical wall 46 in a position to receive the tapered lugs when the two cylindrical walls 46 and 54 are moved into telescoping relation.

The spring pressed valve mechanism 26 includes a valve member, generally indicated at 62, which includes a valve seat engaging element 64 having a valve stem 66 extending downwardly therefrom. The valve mechanism 26 also includes a coil spring 68 which is disposed in surrounding relation with the valve stem 66 with its upper end engaged with the valve seat engaging element 64. The lower conduit part 40 includes an apertured wall 70 which is disposed in downwardly spaced relation with respect to the resilient washer 24. The aperture of the wall 70 receives the lower end portion of the valve stem therethrough and serves to engage the lower end of the coil spring 68 so that the latter will bias the valve member 62 in an upward direction into a valve closing position wherein the valve seat engaging element 64 is disposed in engagement with the valve seat provided by the resilient washer 24.

The opposite sides of the barrel portion of the upper conduit part 52 are flattened. Extending outwardly from opposite sides of the flattened portion is a pair of pivot pin elements 72. The pivot pin elements 72 serve to pivotally mount the trigger member 28 for movement between its inoperative and operative positions. As best shown in FIGS. 3 and 4, the trigger member 28 includes a central trigger portion 74 which is of ribbed wall construction shaped into a trigger formation. Extending upwardly from the upper end of the trigger portion 74 is a pair of transversely spaced mounting portions 76. These mounting portions are disposed on opposite sides of the barrel portion provided by the upper conduit part 52. The mounting portions 76 are centrally apertured to receive therein the pivot pins 72. In this way, trigger member 28 is mounted for pivotal movement about the axis of the pivot pins 72 which axis extends through the water path provided by the central barrel portion of the conduit part 52.

Figure 7:
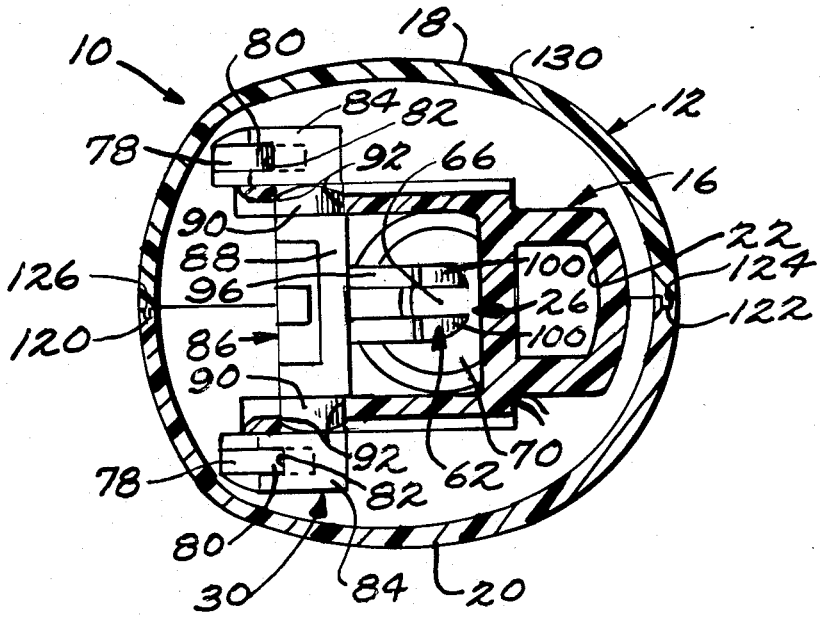
FIG. 7 is an enlarged fragmentary sectional view taken along the line 7—7 of FIG. 3.
Figure 8:
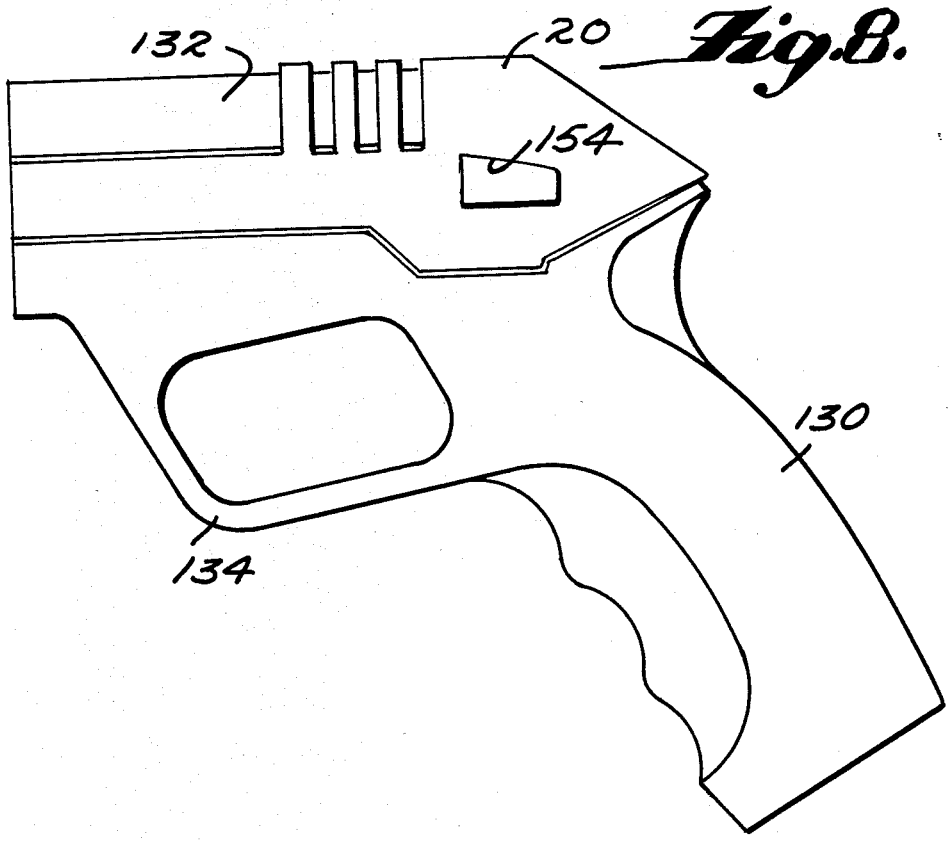
FIG. 8 is a left-hand side elevational view of the left exterior part of the hose nozzle.

The variable leverage motion transmitting mechanism 30 includes a pair of transversely spaced trigger lever arms 78 which are formed integrally with the upper rearward portion of the trigger portion 74. The lower rearward extremities of the trigger lever arms 78 are provided by with rearwardly extending rounded projections 80 which are adapted to slidably engage within corresponding forwardly facing grooves 82 formed in a pair of actuating lever arms 84 forming a part of a pivoting actuating member, generally indicated at 86, constituting a part of the motion transmitting mechanism 30. As best shown in FIG. 3, the lower end portions of the two lever arms 84 are connected together by a integral bite portion 88 of the actuating member which is spaced from the lower extremities of the lever arms 84. Extending outwardly from the lower extremities of the bite portion 88 is a pair of integral pivot pin portions 90. The pin portions 90 are engaged within central openings 92 formed in a pair of forwardly extending transversely spaced wall portions 94 formed on the lower conduit part 40 below the apertured wall 70. As best shown in FIG. 7, each opening 92 is provided when two abutting portions of the molding die are moved apart in a direction perpendicular to the opening. The apertures in the trigger mounting portions 76 for receiving pin portions 72 are preferably formed in the same fashion. Actuating member 86 is thus mounted for pivotal movement about the common axis of the pivot pin portions 90 and apertures 92. The actuating member 86 also includes a bifurcated relatively short lever arm 96 which extends rearwardly from the bite portion 88 so as to embrace opposite sides of the lower extremity of the valve stem 66. The lower rearward extremity of each bifurcation on the lever arm 96 is formed with a downwardly facing arcuate surface 98 which is adapted to engage an associated integral pivot pin portion 100 extending outwardly from the associated side of the lower extremity of the valve stem 66.

It will be understood that the normal operation of the coil spring 68 is such as to apply an increasing force on the valve member 62 as the latter is moved in a direction away from its valve closing position and into its valve opening position. As previously indicated, the variable leverage motion transmitting mechanism 30 is operable to compensate for the increasing spring force and enable an operator to digitally move the trigger member 28 so that the digital force requirements of the user remain comfortable throughout the range of movement of the valve member. This operation is achieved by virtue of the sliding engagement of the arcuate projection 80 of the trigger lever arms 78 with respect to the forwardly facing grooves 82 of the actuating lever arms 84. FIG. 3 illustrates the position of the variable leverage motion transmitting mechanism 30 when the trigger member 28 is in its inoperative position and the valve member 62 is in its valve closing position. It will be noted that the position of the engagement of the projection 80 with the lever arms 84 is such as to be relatively closely spaced with respect to the pivotal axis of the actuating member 86. FIG. 4 illustrates the position of the variable leverage motion transmitting mechanism 30 when the trigger member 28 has been moved into its operative position and the valve member 62 has been moved into its valve opening position. It will be noted that the position of the trigger lever arm projections 80 with respect to the grooves 82 in the actuating member lever arms 84 is now disposed a relatively greater distance away from the pivotal axis of the actuating lever 86. It will be noted that the digital force is applied to the trigger member 28 at a relatively constant position so that the digital force applied to the trigger member acts through a relatively constant lever arm or distance from the pivotal axis of the trigger member. Similarly, the position of the trigger lever arm projections 80 with respect to the pivotal axis of the trigger member 28 is likewise constant. It will also be noted that a relatively constant lever arm at all times exists with respect to the relatively short rearwardly extending actuating lever arm 96 since the distance between the pivotal axis of the lever arm and the position of application by virtue of the curved surfaces 98 stays relatively constant. The transmittal of the relatively constant trigger force from the trigger member 28 to the actuating member 86 is through a variable lever arm by virtue of the sliding movement of projections 80 within grooves 82 as aforesaid. This lever arm increases from the relatively short length shown in FIG. 3 to the relatively longer length shown in FIG. 4. This increase compensates for the increase in the spring pressure and thus enables the digital force requirements of the user to remain comfortable throughout the range of movement of the valve member 62.

The trigger retaining mechanism is preferably in the form of a single molded plastic member which is mounted on the upper conduit part 52. As best shown in FIG. 3, the rearward portion of the upper conduit part 52 has formed thereon an integral arcuate shaft receiving element 102. The element 102 is inherently resilient by the nature of the plastic material out of which it is made and is sized to receive therein a central shaft portion 104 of the plastic member constituting the trigger retaining mechanism 32. The shaft portion 104 extends outwardly beyond both sides of the arcuate shaft receiving portin 102. Extending integrally upwardly from the outward extending ends of the shaft portion 104 is a pair of upwardly and forwardly arching arm portions 106. The forward ends of the arm portion 106 are provided with forwardly facing trigger engaging surfaces 108. These surfaces are disposed in a position so as to engage beneath the rearwardly facing surfaces 110 formed on the upper rearward ends of the mounting portions 76 of the trigger member 28.

As best shown in FIGS. 4 and 5, when the trigger member 28 is disposed in its operative position, the surfaces 110 are disposed in a position such that a counterclockwise movement of the retaining member 32, as viewed in either Figure, will serve to dispose the trigger engaging surfaces 108 thereof in abutting relation with the trigger surfaces 110. This engagement serves to retain the trigger member 28 against pivotal movement in a clockwise direction, as viewed in FIGS. 4 and 5, so that when the finger of the user is removed from the trigger member 28, coil spring 68 cannot operate through the motion transmitting mechanism 30 to move the trigger in a clockwise direction, as viewed in FIGS. 4 and 5, back out of its operative position.

As previously indicated, preferably, the retaining member is biased to move out of its operative position. As best shown in FIG. 3, the mounting arm portions 106 at positions just rearwardly of the forwardly facing trigger engaging surfaces 108 are interconnected by a bite portion 110. Extending forwardly and downwardly from the center of the bite portion 110 is a cantilever spring arm 112. The free end of the cantilevered spring arm 112 is positioned to engage the upper surface of the upper end conduit part 52. The trigger retaining member 32 is moved from its normally biased inoperative position into its operative position by a pair of laterally outwardly extending thumb engaging portions 114. The inner ends of the thumb engaging portions 114 are integrally interconnected with the adjacent extremities of the shaft portion 104, as by mounting arm portions 116.

It can be seen that pressing downwardly on either of the thumb engaging portions 114 will have the effect of moving the trigger retaining member 32 in a counterwise direction, as viewed in FIGS. 4 and 5, from its normally biased position, as shown in FIG. 4, into the trigger retaining operative position, as shown in FIG. 5. During this movement cantilevered spring arm 112 is stressed. It will be understood that the force of the valve coil spring 68 and the nature of the motion transmitting mechanism is such that after the user has released the trigger member 28 with the trigger retaining member 32 in its operative position, as shown in FIG. 5, the operator may release the thumb from the thumb engaging portion 114 and the trigger retaining member 32 will be retained in its trigger retaining operative position against the bias provided by the cantilever spring arm 112. The operator need only slightly depress the trigger 28 to enable the trigger retaining member 32 to return into its inoperative position under the bias of the cantilever spring arm 112.

Figure 9:
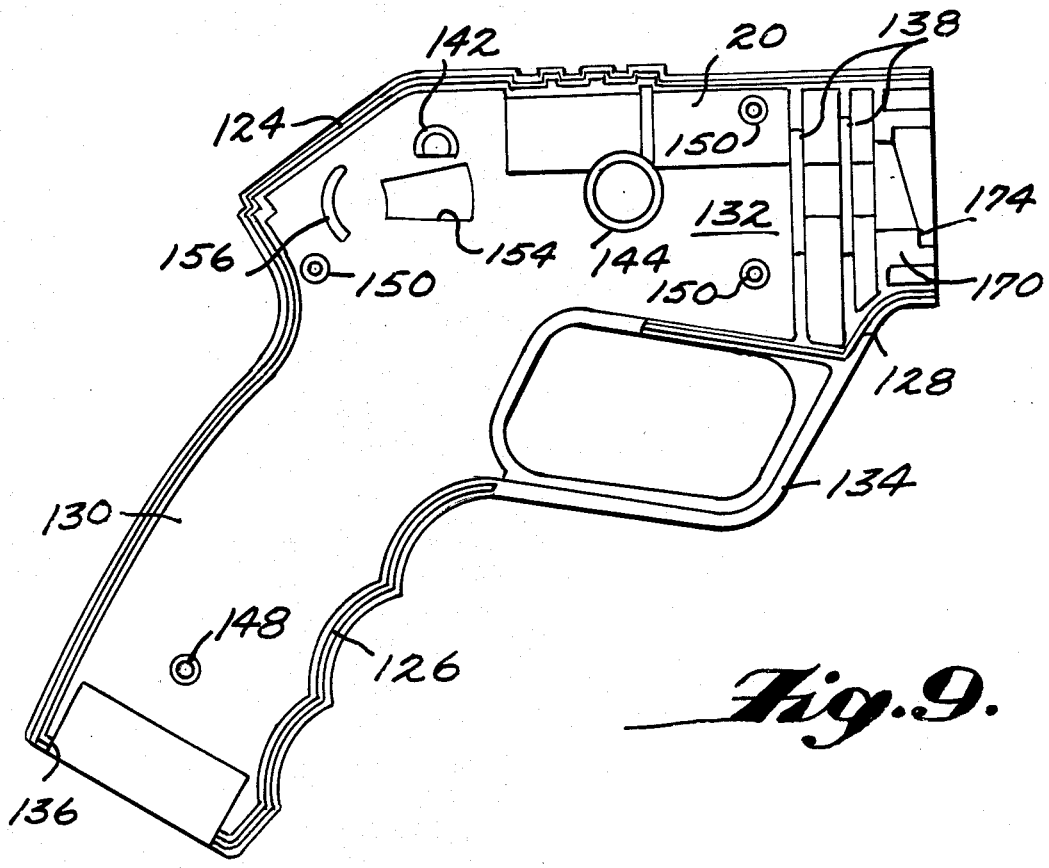
FIG. 9 is a right-hand side elevational view of the exterior part shown in FIG. 8.

The exterior parts 18 and 20 are preferably mirror image side by side half shell plastic molded parts. The shell part 18 is shaped so as to provide an upper peripheral edge 118 which is formed with a projecting tongue. A similar edge 120 is formed along the lower forward portion thereof and another such edge is provided at the upper forward portion thereof, as indicated at 122. As best shown in FIG. 9, the shell part 20 includes an upper peripheral edge 124 which is formed with a recessed groove suitable to mate with the tongue of the peripheral edge 118. In addition, the shell part 20 includes a grooved edge 126 for cooperating with the tongued edge 120 and a grooved edge 126 for cooperating with the tongued edge 122.

Figure 1:
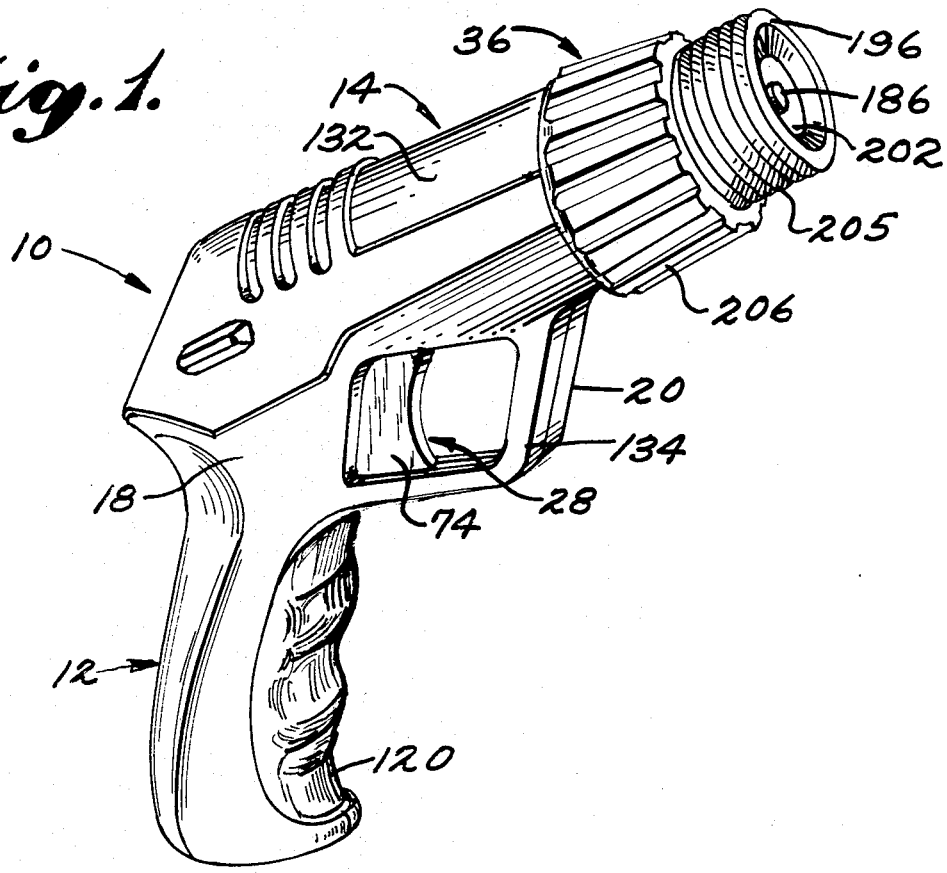
FIG. 1 is a perspective view of a hose nozzle embodying the principles of the present invention showing the same with the adjustable spray assembly detachably mounted in the outlet thereof.
Figure 2:
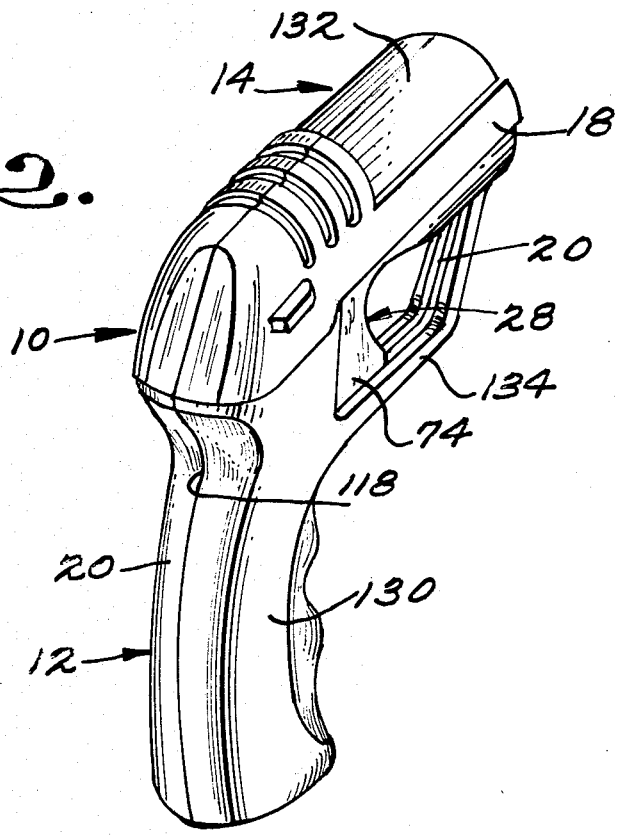
FIG. 2 is a perspective view of the hose nozzle shown in FIG. 1 as it would be used in a sweeper mode with the adjustable spray assembly removed from its outlet.

As best shown in FIGS. 1 and 2, when the aforesaid peripheral edges of the shell parts 18 and 20 are interengaged, the shell parts provide an exterior periphery which simulates a pistol. Thus, the parts together provide an exterior handle portion 130 which is shaped to grip the hand of the user and forms the exterior portion of the handle structure 12. Similarly, the shell parts when together provide a barrel portion 132 which extends forwardly from the upper end of the handle portion 130 and constitutes the exterior portion of the barrel structure 14. In addition, the shell parts provide a trigger guard 134 which extends forwardly from the handle portion 130 below the barrel portion 132 alongside the lower surface of the trigger member 28 and then upwardly into engagement with the barrel portion 132 forwardly of the handle portion 130 and the trigger member 28.

It will also be noted that the interior periphery of each shell part 18 and 20 is such as to enclose the inner conduit 16, the valve member 62, the spring 68 and the motion transmitting mechanism 30 to an extent such that the gun simulating exterior periphery thereof together with the trigger member 28 and the water outlet assembly 36, if used, constitutes substantially the entire visual appearance of the hose nozzle. Moreover, it will be noted that the interior periphery is disposed in spaced relation with respect to the valve member 62, the spring 68 and the motion transmitting mechanism 30 to an extent sufficient to accommodate the movements thereof. Finally, it will be noted that the interior periphery of the shell parts is spaced from an extent of the exterior periphery of the handle portion of the inner conduit 16 sufficient to define an insulating air space suitable to render the handle portion 130 of the exterior periphery of the exterior parts 18 and 20 more comfortable to grip when water at an uncomfortable temperature is flowing through the flow path 22 provided by the conduit 16.

In addition to the spaced relationship noted above, there is a fixed abutting relationship between the interior periphery of the shell parts 18 and 20 and the inner conduit such that the latter is rigidly and fixedly secured within the shell parts. As best shown in FIG. 9, each shell part is formed with an arcuate interior surface 136 adjacent the lower end of the handle portion 130. In addition, a pair of interior ribs adjacent the forward end of the barrel portion 132 of each shell part is formed with arcuate surfaces 138. The arcuate surfaces 136 and 138 thus serve to fixedly engage the lower end of the handle portion of the conduit 16 and the forward end of the barrel portion. Formed on the upper conduit part 52 at a position just forwardly of the arcuate portion 102 is an integral mounting portion which includes two outwardly extending pin portions 140. The interior periphery of each of the shell parts is formed with an apertured boss 142 to fixedly receive an associated one of the pin portions 140. In addition to this three position securement, each shell part includes on its interior periphery an apertured boss 144 disposed in a position to receive the extremity of the integral pin portions 72 extending beyond the mounting portions 76 of the trigger member 28. Moreover, as shown in FIG. 4, the lower conduit part 40 has a pair of integral oppositely extending pin portions 146 formed on the lower exterior periphery thereof. Each shell part is provided with an apertured boss 148 to fixedly receive an associated mounting pin 146.

The interior periphery of shell part 18 also includes a plurality of apertured bosses 150. As best shown in FIG. 3, two such apertured bosses are located adjacent the forward end of the barrel portion and one is located at the upper rear of the handle portion. These apertured bosses receive corresponding pin bases 152 on the shell part 20. All of the interengaged surfaces of the two parts are preferably secured together, as by a suitable adhesive so as to fixedly secure the two shell parts in peripheral edge abutting engagement and in fixed relation with respect to the inner conduit 16.

It will be noted that each shell part is formed with a segmentally shaped opening 154 for receiving therethrough an associated thumb engaging portion 114 of the trigger retaining member 32. In addition, an arcuate wall 156 is formed on the interior periphery of each shell part rearwardly of the opening 154 for insuring the retention of the shaft portion 104 of the trigger retaining member 32 within the arcuate portion 102 forming a part of the upper conduit part 52.

The fixed orifice member 34 may be of any suitable construction and, as shown, consist essentially of a molded plastic tubular body having a forwardly extending exterior flange 158 which is suitably fixed within the interior periphery of the upper conduit part 52 in inwardly spaced relation to the forward extremity thereof. The tubular body also provides a converging nozzle orifice 160 and a plurality of flow directing interior fins 162.

The forward end of the upper conduit part 52, which is forwardly of the fixed nozzle member 34, is formed with a coupling means, generally indicated at 164, which is adapted to detachably interengage with cooperating coupling means provided on the adjustable spray assembly 36 and the rotary nozzle output assembly 38. As shown, the coupling means includes a shallow interior frustoconical sealing surface 166 which is disposed forwardly of the fixed orifice nozzle member 34. Formed on the interior periphery of the upper conduit part 52 at the forward extremity thereof is an annular recess 168. It will also be noted that each shell part includes an arcuate wall 170 disposed on the interior periphery thereof adjacent the forward end of the barrel portion. The wall 170 has a rearwardly facing surface wiich abuttingly engages the forward edge of the upper conduit part 52 and the interior periphery of the arcuate wall is such as to enclose the forward end of the recess 168 into an annular groove within which an O-ring 172 is mounted. As best shown in FIG. 3, the size of the O-ring 172 is such that its inner periphery extends radially inwardly beyond the adjacent interior periphery provided by the forward end of the upper conduit part 52 and the adjacent arcuate wall 170. Moreover, each arcuate wall 170 also includes a forwardly facing inclined cam surface 174.

As previously indicated, the adjustable spray assembly 36 is provided with coupling means for detachably interengaging with the coupling means 164 provided in the barrel structure of the hose nozzle 10. As best shown in FIG. 3, this coupling means includes a rearwardly extending tubular portion 176 forming an integral part of the assembly 36. As shown, the tubular portion includes a cooperating exterior frustoconical rearward surface 178 which leads into an O-ring receiving annular groove 180. In addition, a pair of cam surfaces 182 are formed inwardly of the annular groove in such a way that they face rearwardly in a position to engage the cam surfaces 174 of the coupling means 164.

The tubular portion 176 constitutes the rearward portion of an inner member 184 constituting one of the components of the adjustable spray assembly 36. As shown in FIG. 3, the inner member 184 has formed on its forward end a spray defining element 186 which leads to an exterior frustoconical surface 188. Rearwardly of the frustoconical surface 188, the inner member 184 is formed with a series of radially extending openings 190 which communicate with an interior passage 192 communicating with the interior of the rearward tubular coupling portion 176. The central exterior of the inner member 184 is provided with exterior threads 194 which are adapted to mesh with interior threads formed on an outer tubular nozzle member 196. The central interior periphery of the nozzle member 196 is formed with a cylindrical surface which is adapted to be sealingly engaged by an O-ring 200 mounted in an annular groove in the exterior periphery of the inner member 184 at a position rearwardly adjacent the openings 190. The nozzle member 196 includes a forward wall 202 which is centrally apertured, as indicated at 204, to provide an outlet orifice within which the spray modifying element 186 extends.

As shown, the forward exterior periphery of the nozzle member may be formed with threads 205 for engaging with a female hose fitting or the like. Fixed to the exterior periphery of the nozzle member 196 rearwardly of threads 205 is a turning sleeve 206. As shown in FIG. 1, the exterior periphery of the turning sleeve 206 is suitably interrupted to provide frictional engagement with the hand of a user.

It will be noted that by turning the actuating sleeve, the axial position of the nozzle member 196 can be adjusted with respect to the fixed inner member 184. In the position shown in FIG. 3, the frustoconical surface 188 of the inner member is engaged by the adjacent surface defining the outlet orifice 204 and hence flow is cut off. As the turning of the sleeve 206 moves the nozzle member 196 outwardly, water is allowed to pass through the annulus defined by the exterior periphery of the spray defining element 186 and the interior periphery of the nozzle orifice 204. The position of the spray modifying element 186 within the orifice defines the nature of the spray which is emitted through the orifice, all in accordance with conventional practice.

Turning sleeve 206 is turned in a clockwise direction, as viewed in FIG. 1, to move the nozzle member 196 into its closed position. When a further turning force is applied to the turning sleeve 206 in the same clockwise direction, engaged cam surfaces 174 and 182 begin to slide with respect to one another which causes the fixed inner member 184 together with the tubular coupling 176 to move forwardly.

At the end of a half turn, the inner member 184 has been moved forwardly a distance sufficient to dislodge the O-ring 172 from the groove 180 so that the entire assembly 36 can then be easily detached from the barrel structure 14 of the nozzle 10 rendering it suitable for operation with the jet stream orifice 160, as shown in FIGS. 2 and 4.

It will be understood that the hose nozzle 10 in the condition shown in FIGS. 2 and 4 is capable of detachably fixedly receiving the adjustable spray assembly 36 by simply rotationally aligning the same with the barrel structure and then pushing the same rearwardly until frustoconical surfaces 166 and 178 interengage, O-ring 172 enters groove 180 and cam surfaces 174 and 182 are confrontingly engaged. In this position the interengagement of the walls, perpendicular to the high ends of the cam surfaces 174 and 182, prevent relative rotational movement between the fixed inner member 184 and the barrel structure 14 of the hose nozzle 10. Alternatively, instead of the adjustable spray assembly 36, the hose nozzle 10 in the condition shown in FIGS. 2 and 4 is capable of detachably fixedly receiving the rotary nozzle outlet assembly 38.

Figure 10:
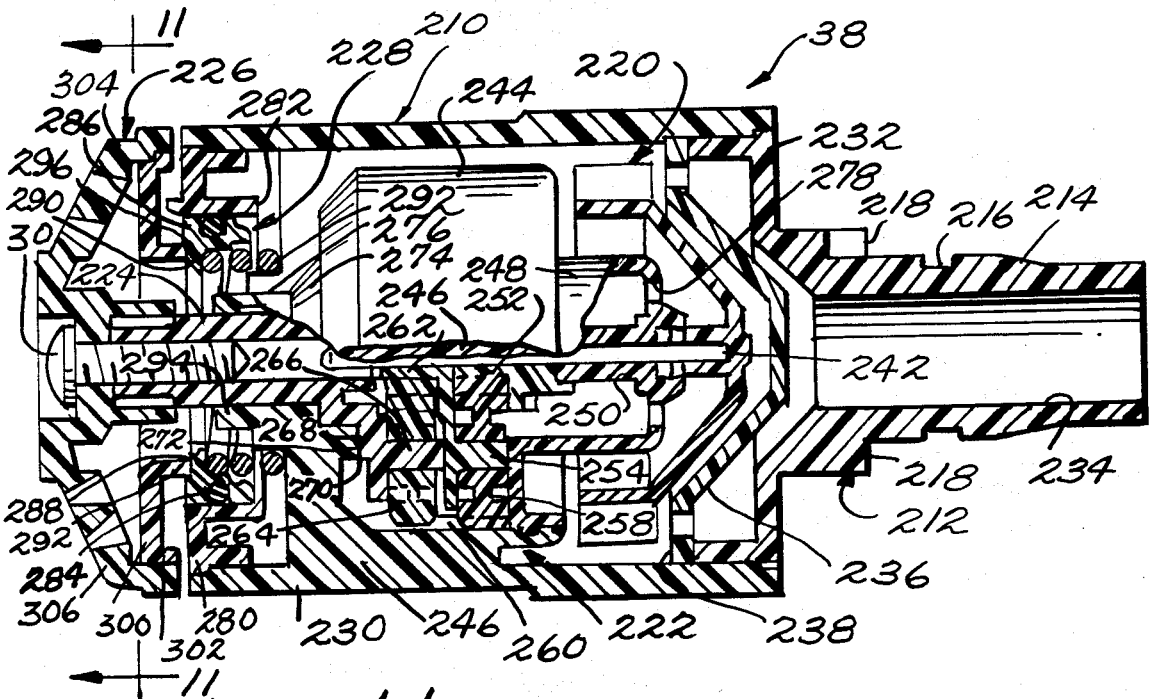
FIG. 10 is a vertical sectional view of a rotary nozzle outlet assembly which may be utilized in lieu of the adjustable spray outlet assembly shown in FIGS. 1 and 3.
Figure 11:
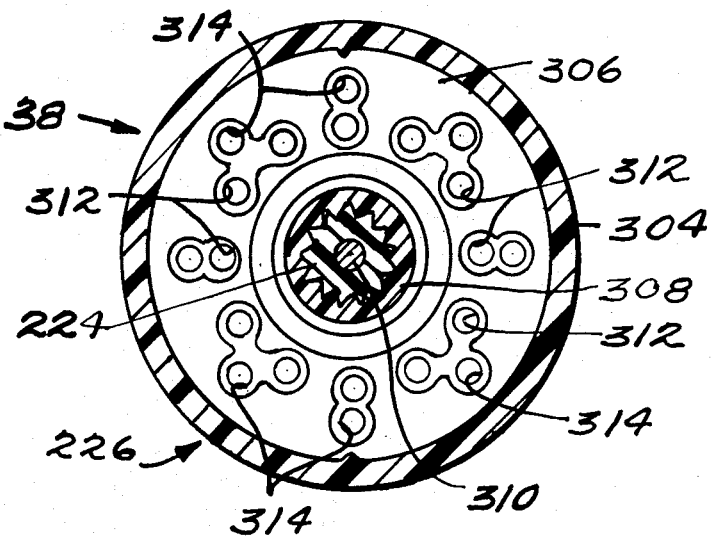
FIG. 11 is a sectional view taken along the line 11—11 of FIG. 10.

Referring now more particularly to FIGS. 10 and 11 of the drawings, the rotary output assembly 38 is shown therein. The assembly 38 is constructed in accordance with the teachings of my copending application, Ser. No. 875,097 filed June 17, 1986, the disclosure of which is hereby incorporated by reference into the present specification. As shown, the rotary output assembly 38 includes a housing assembly, generally indicated at 210, which provides a rearwardly extending tubular coupling portion 212 constructed in a manner similar to the tubular coupling portion 176 of the adjustable spray assembly 36. Thus, coupling portion 212 includes a cooperating exterior frustoconical rearward surface 214 which leads into an O-ring receiving annular groove 216. In addition, a pair of cam surfaces 218 are formed inwardly of the annular groove 216 in such a way that they face rearwardly in a position to engage the cam surfaces 174 of the coupling means 164.

Mounted within the housing assembly 210 is a water impeller 220 which is connected through a speed reducing unit, generally indicated at 222, to an output shaft 224. Fixed to the output shaft 224 is a rotary water distributor, generally indicated at 226, which receives water under pressure flowing within the housing assembly 210 and distributes the same with a rotary motion. An annular spring pressed seal assembly, generally indicated at 228, serves to provide a seal between the rotary distributor 226 and the housing assembly 210 for containing the water under pressure therein so that the same will pass outwardly through the rotary distributor 226.

As best shown in FIG. 10, the housing assembly 210 includes a main plastic housing body which includes a cylindrical outer wall 230 disposed with its axis extending concentrically with the axis of the tubular coupling portion 212. As shown, the forward end of the tubular portion 212 is formed with an L-shaped outwardly extending mounting flange 232 which is fixed at its outer periphery with the rearward end of the outer wall 230. As shown, the interior of the tubular portion 212 defines an inlet 234 which is open at its outer end to receive the water under pressure within the hose nozzle 10. The inner end of the inlet 234 opens axially into a space defined by an apertured inner wall 236 which in turn directs the water axially into an annular chamber 238 defined in the rearward open end of the outer wall 230 which is closed by the flange 232. The chamber 238 constitutes an impeller chamber within which the impeller 220 is rotatably mounted. As shown, the impeller 220 is fixed to the rearward end of an input shaft 242 forming a part of the speed reducing unit 222.

The speed reducing unit 222 may be made of any desired construction. However, as shown, the speed reducing unit is preferably in the form of a plurality of planetary gear sets which are suitably mounted between the input shaft 242 and the output shaft 224. The planetary gear sets are mounted within a casing construction the majority of which is provided by an inner cylindrical wall 244 disposed in concentric relation with the outer cylindrical wall 230 and integrally interconnected therewith by a plurality (e.g. four) of annularly spaced ribs 246 extending radially inwardly from the inner periphery of the outer cylindrical wall 230 to the exterior periphery of the inner cylindrical wall 234. The inner wall 234 opens rearwardly and is closed by a closure member 248 which constitutes a part of the casing for the speed reducing unit.

The closure member 248 includes a hub 250 which serves to rotatably mount the portion of the input shaft 242 directly forwardly of the connection thereof with the impeller 220. Fixed to the shaft 242 forwardly of the hub 250 is a sun gear 252 forming a part of the first planetary gear set which includes a carrier 254 defining a plurality of annularly spaced shafts 256 on which are journalled a plurality of planet gears 258. The exterior periphery of the planet gears 258 are adapted to mesh with gear teeth 260 integrally formed on the interior periphery of the inner cylindrical wall 244. The gear teeth 260 constitute a common orbital gear for all of the planetary gear sets. In this regard it will be noted that the carrier 254 also has formed on the forward central portion thereof a sun gear 262 which meshes with a series of planet gears 264 journalled on shafts 266 formed as an integral part of the rear portion of the output shaft 224. As shown, the output shaft 224 also provides a forwardly facing annular shoulder 268 on which is mounted an antifriction washer 270. Washer 270 also engages a rearwardly facing surface of a depending sleeve portion 272 formed on an annular wall portion 274 extending radially inwardly from the forward end of the inner cylindrical wall 244. The inner periphery of the annular wall portion 274 includes a forwardly projecting annular portion 276 which is disposed in surrounding relation to the rearward portion of the output shaft 224.

The antifriction washer 270 serves as an effective watertight seal for the forward end of the casing, the rearward end of which is provided with openings 278 which allow for the introduction of water into the interior of the casing in surrounding relation to the planetary gear sets operative therein.

Mounted within the open forward end of the outer cylindrical wall 230 of the housing assembly 210 is an annular member 280 which constitutes a forward end closure for the housing assembly. Annular member 280 includes an inner cylindrical wall 282 defining an interior cylindrical surface 284. The surface 284 constitutes an outlet for the water under pressure which is introduced into the interior of the housing assembly 210 through the inlet 234. The annular sealing assembly 228 includes an annular sealing member 286 which is disposed within the outlet 284 in surrounding relation with the output shaft 224 which extends forwardly through the outlet 284.

The annular seal assembly 228 also includes an O-ring 288 which is suitably mounted within an annular groove formed in the annular seal member 286 and disposed so that its exterior periphery slidably sealingly engages the interior cylindrical surface 284 defining the opening. The annular sealing member 286 includes a spring engaging annular flange portion 290 extending radially inwardly from the forward end thereof. The rearward surface of the annular flange portion 290 is adapted to engage the forward end of a coil spring 292 which is disposed in surrounding relation with the housing portion 276 and the adjacent portion of the output shaft 224. Preferably, the inner forward ends of each of the ribs 246 is formed with an upwardly extending guide portion 294. The guide portions 294 extend within the rearward volutes of the spring 292 and serve to maintain the spring in centered relation. The spring 292 thus serves to resiliently urge the sealing member 286 in a forward direction so that the forwardly facing surface defined by the flange portion 290 will sealingly engage a rearwardly facing annular sealing surface 296 formed on rearward annular interior peripheral flange portion 298 of a rotary head member 300 forming a part of the rotary distributor 226. The rotary head member 300 also includes a rearward annular exterior peripheral flange portion 302 which is fixed exteriorly to the interior of a peripheral flange 304 of an annular nozzle member 306. The nozzle member 306 has a central interiorly splined shaft engaging socket portion 308. The socket portion 308 is configured to be fixed to the upper end of the output shaft 224 which is provided with cooperating exterior splines. As shown, a fastener 310, having its head engaged with the socket portion 308 and its threaded shank engaged within the output shaft 224, serves to effect the fixed relationship therebetween.

The nozzle member 306 includes a multiplicity of annularly spaced water inner and outer outlet orifices 312 and 314. As best shown in FIG. 11, there are twelve inner outlet orifices 312 provided, each being of generally converging nozzle configuration and each having its axis extending forwardly from the rearward surface of the member 306 at an angle of approximately 15°. In addition to the inner outlet orifices 312, there are eight outer outlet orifices 314 provided. As before, each orifice 314 is of generally converging nozzle configuration; however, the axis of each is disposed at an angle of 25° with respect to the axis of rotation of the rotary distributor. The rotary nozzle outlet assembly 38 is detachably interengaged with the barrel structure 14 of the hose nozzle 10 in the same manner as the adjustable spray assembly 36, previously described.

When coupled and communicated with water under pressure by the operation of the hose nozzle, the water entering the inlet 234 passes forwardly through the apertured wall 236 into the impeller chamber 238 in a direction such as to cause the latter to rotate. The relatively rapid rotation of the impeller 220 is transmitted as a relatively slow rotational movement of the output shaft 224 by the operation of the gear reducing mechanism 222. Since the rotary distributor 228 is fixed to the output shaft 224, the rotary distributor 226 is likewise rotated at a relatively slow speed as compared with the speed of the impeller 220. The water flowing forwardly through the impeller chamber 238 passes between the outer cylindrical wall 230 and the inner cylindrical wall 244, past ribs 246 and then forwardly between the tubular portion 276 and annular seal 228 into the rotary distributor 226. The water within the rotary distributor issues from the inner and outer outlets 312 and 314 as the rotary distributor is rotated.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. A hose nozzle comprising a handle structure having an exterior periphery shaped to be gripped by a hand of a user, said handle structure including a lower end portion having a female hose fitting therein, a barrel structure extending forwardly from the upper end of said handle structure, water outlet means at the forward end of said barrel structure, means within said handle and barrel structures defining a water flow path extending upwardly from said female hose fitting through said handle structure and forwardly to said water outlet means through said barrel structure, means defining a valve seat in said flow path, a valve member mounted for movement toward and away from said valve seat between valve closing and valve opening positions, spring means for resiliently urging said valve member toward said valve closing position with a spring force which progressively increases from an initial force as said valve member is moved away from said valve closing position to a greater final force as said valve member is moved toward said valve opening position, a trigger member disposed at the juncture of said handle and barrel structures below said barrel structure and forwardly of said handle structure and mounted for digital movement from an inoperative position into an operative position, a motion transmitting mechanism connecting the trigger to the valve and having a leverage varying means for effecting a movement of said valve member from said valve closing position into said valve opening position against the urging of said increasing spring force in response to a digital movement of said trigger member from said inoperative position into said operative position by a digital force which varies from an initial force required to move said trigger member away from said inoperative position to a final force required to move said trigger member into said operative position, the final force to initial force ratio of the trigger member movement being substantially less than the final force to initial force ratio of the valve member movement so as to compensate for the increasing spring force and enable the digital force requirements of the user to remain comfortable throughout the range of movement of said valve member.

2. A hose nozzle as defined in claim 1 wherein said trigger member is mounted for pivotal movement about an axis extending through said barrel structure.

3. A hose nozzle as defined in claim 2 wherein said variable leverage motion transmitting mechanism includes a trigger lever arm fixed to said trigger member for pivotal movement therewith.

4. A hose nozzle as defined in claim 3 wherein said variable leverage motion transmitting mechanism includes a valve operating member mounted for pivotal movement about an axis extending through said handle structure near the lower end thereof, said valve operating member including a relatively short lever arm connected to move said valve member against the bias of said spring means and a relatively long lever arm, said relatively long lever arm being slidably engaged by the end of said trigger lever arm in such a way that the distance of the effective engagement position from the pivotal axis of said valve operating member increases as said trigger member moves away from said inoperative position and toward said operative position.

5. A hose nozzle as defined in claim 1 wherein said valve member includes an annular valve element having a valve stem extending therefrom, said spring means comprising a coil spring surrounding said valve stem with one end operatively engaged with said valve element and the other operatively engaged with said handle structure.

6. A hose nozzle as defined in claim 1 wherein said water outlet means includes a member defining a fixed orifice for directing water from the forward end of said barrel structure with a jet stream suitable for sweeping walks and the like.

7. A hose nozzle as defined in claim 6 wherein said water outlet means further includes an adjustable spray assembly selectively detachably mountable on said barrel structure downstream of said fixed orifice defining member in water receiving relation with respect to the water flowing from said fixed orifice defining member for directing the water flowing therefrom in any selected one of a multiplicity of different spray streams so that the user may select as the water output of the hose nozzle either the jet stream flowing from said fixed orifice defining member by detaching said adjustable spray assembly from said barrel structure or the selected spray stream flowing from said adjustable spray assembly by detachably mounting the latter on said barrel structure.

8. A hose nozzle as defined in claim 7 wherein said adjustable spray assembly comprises one of a series of different outlet assemblies, detachable interengaging coupling means on each of said outlet assemblies and said barrel structure for enabling a user to detachably interconnect a selected one of said set of different outlet assemblies on said barrel structure in flow receiving relation to the water outlet therein so that water flowing from said water outlet will be caused to flow in a stream determined by the selected interconnected outlet assembly.

9. A hose nozzle as defined in claim 8 wherein said detachable interengaging coupling means on said barrel structure includes a shallow frustoconical interior sealing surface within the forward end of said barrel structure and means mounting an O-ring seal in the interior periphery of said barrel structure at a position between the outer extremity thereof and said frustoconical surface, said O-ring having a substantial portion of its interior periphery extending inwardly of the adjacent interior frustoconical surface within said barrel structure and inwardly facing cam surface means within said barrel structure outwardly of said O-ring, each of said outlet assemblies including a tubular coupling portion extending rearwardly therefrom for engaging rearwardly within the forward end of said barrel structure, each tubular coupling portion having an exterior frustoconical surface of a size and shape to be moved rearwardly into engaged sealing relation to the interior frustoconical surface of said barrel structure, an exterior annular groove disposed forwardly of said exterior frustoconical surface for receiving the interior periphery of said O-ring when said frustoconical sealing surfaces are in engagement and rearwardly facing cam surface means disposed forwardly of said annular groove for engaging the forwardly facing cam surface means on said barrel structure when said O-ring is disposed in said groove operable in response to a turning movement of said tubular coupling portion with respect to said barrel structure to cam the tubular coupling portion forwardly with respect to said barrel structure so as to displace said O-ring from within said groove.

10. A hose nozzle as defined in claim 8 wherein a second outlet assembly of said series comprises a rotary outlet assembly, said rotary outlet assembly including a housing assembly having a rearwardly extending tubular portion carrying said coupling means and defining an inlet, said housing assembly having a fixed annular wall providing an interior periphery defining an annular forwardly opening water outlet, speed reducing means within said housing assembly having an input shaft, an output shaft extending forwardly through said outlet in a fixed position of rotational movement and a series of meshing speed reducing gears between said shafts whereby said output shaft is rotated at a speed less than the speed of the input shaft, impeller means drivingly associated with said input shaft and mounted within said housing assembly in a position to be rotated by water under pressure flowing from said inlet to said outlet, a rotary water distributor fixed to said output shaft and disposed in water communicating relation with said outlet, said rotary water distributor including a rearwardly facing annular sealing surface, an annular member mounted for axial movement within said annular water outlet and in surrounding relation with said output shaft, said annular member having an exterior periphery disposed within the interior periphery of said fixed annular wall, an O-ring seal sealingly mounted between the exterior periphery of said annular member and the interior periphery of said fixed annular wall in such a way as to accommodate any relative axial movement of said annular member with respect to said fixed annular wall, means on said annular member defining a forwardly facing sealing surface for sealingly engaging the rearwardly facing sealing surface of said rotary water distributor, spring means acting between said housing assembly and said annular member for resiliently urging the latter forwardly so as to maintain said forwardly facing sealing surface in sealing engagement with the rearwardly facing sealing surface of said rotary water distributor, said housing assembly providing interior flow directing surfaces for directing the water therein to flow from said impeller means and then upwardly between said output shaft and said annular member into communicating relation to rotary water distributor.

11. A hose nozzle as defined in claim 1 wherein said handle and barrel structures are defined by an interior water handling conduit providing interior handle and barrel portions of said handle barrel structures respectively and a plurality of cooperating exterior parts fixed together in surrounding relation to said interior water handling conduit so as to provide exterior handle and barrel portions of said handle and barrel structures respectively, said exterior parts enclosing (1) said inner conduit (2) said valve member, (3) said spring means and (4) said motion transmitting means to an extent such that the gun simulating exterior periphery thereof together with trigger member and said water outlet means constitutes substantially the entire visual appearance of said hose nozzle, said exterior parts presenting an interior periphery disposed in spaced relation with respect to (1) said valve member, (2) said spring means and (3) said motion transmitting means to an extent sufficient to accommodate the movements thereof and (4) an extent of the exterior periphery of the handle portion of said inner conduit sufficient to define an insulating air space suitable to render the handle portion of the exterior periphery of said exterior parts more comfortable to grip when water at an uncomfortable temperature is flowing through said flow path.

12. A hose nozzle as defined in claim 11 wherein said exterior parts are in the form of two opposite side shells having opposed peripheral edges fixed in abutting side by side relation.

13. A hose nozzle as defined in claim 12 wherein said exterior parts provide a trigger guard extending forwardly from said exterior handle portions below said trigger member and upwardly to said exterior barrel portions in front of said trigger member.

14. A hose nozzle as defined in claim 13 wherein said interior water handling conduit is formed by an upper conduit part defining the interior barrel portion and an upper end section of said interior handle portion and a lower conduit part defining a lower end section of said interior handle portion, means for sealingly connecting said upper and lower end sections including a resilient washer defining said valve seat.

15. A hose nozzle as defined in claim 14 wherein said lower conduit part inlcudes an apertured wall facing toward said valve seat in spaced relation thereto, said valve member including an annular valve element and a valve stem extending therefrom through said apertured wall, said spring means comprising a coil spring surrounding said valve stem between said valve element and said apertured wall.

16. A hose nozzle as defined in claim 15 wherein said female hose fitting comprises a separate member fixed within the lower end of said lower conduit part, said upper conduit part having a pair of side pins extending outwardly thereof at positions near the juncture between said interior barrel and handle portions, said exterior parts having sockets fixedly receiving said pins, lower interior arcuate surfaces fixedly receiving the exterior periphery of said female fitting and forward arcuate surfaces fixedly receiving the exterior periphery of the forward end of said upper conduit part.

17. A hose nozzle as defined in claim 1 wherein means is provided for selectively retaining said trigger member in its operative position.

18. A hose nozzle as defined in claim 17 wherein said trigger retaining means comprises a single trigger retaining member mounted for pivotal movement between an inoperative position and a trigger retaining position, said trigger retaining member including an integral cantilever spring arm arranged so as to resiliently bias said member toward its inoperative position.

19. A hose nozzle comprising a handle structure, a barrel structure extending forwardly from the upper end of said handle structure, said handle and barrel structures being defined by an interior water handling conduit providing interior handle and barrel portions of said handle and barrel structures respectively and a plurality of cooperating exterior parts fixed together in surrounding relation to said interior water handling conduit so as to provide exterior handle and barrel portions of said handle and barrel structures respectively, said interior handle portion including a lower end portion having a female hose fitting therein, water outlet means at the forward end of said interior barrel portion, means within said interior handle and barrel portions defining a water flow path extending upwardly from said female hose fitting through said interior handle portion and forwardly to said water outlet means through said interior barrel portion, valve means mounted in said flow path for movement between valve closing and valve opening positions, a trigger member mounted at the juncture of said exterior handle and barrel portions below said exterior barrel portion and forwardly of said exterior handle portion for digital movement from an inoperative position into an operative position, and motion transmitting means for effecting a movement of said valve means from said valve closing position into said valve opening position in response to a digital movement of said trigger member from said inoperative position into said operative position, said exterior parts presenting a gun simulating exterior periphery, the handle portion of which is shaped to be gripped by a hand of the user, said exterior parts enclosing (1) said inner conduit (2) said valve means, and (3) said motion transmitting means to an extent such that the gun simulating exterior periphery thereof together with trigger member and said water outlet means constitutes substantially the entire visual appearance of said hose nozzle, said exterior parts presenting an interior periphery disposed in spaced relation with respect to (1) said valve means, (2), said motion transmitting means to an extent sufficient to accommodate the movements thereof and (3) an extent of the exterior periphery of the handle portion of said inner conduit sufficient to define an insulating air space suitable to render the handle portion of the exterior periphery of said exterior parts more comfortable to grip when water at an uncomfortable temperature is flowing through said flow path.

20. A hose nozzle as defined in claim 19 wherein said exterior parts are in the form of two opposite side shells having opposed peripheral edges fixed in abutting relation.

21. A hose nozzle as defined in claim 20 wherein said exterior parts provide a trigger guard extending forwardly from said exterior handle portions below said trigger member and upwardly to said exterior barrel portions in front of said trigger member.

22. A hose nozzle as defined in claim 21 wherein said interior water handling conduit is formed by an upper conduit part defining the interior barrel portion and an upper end section of said interior handle portion and a lower conduit part defining a lower end section of said interior handle portion, means for sealingly connecting said upper and lower end sections including a resilient washer defining a valve seat.

23. A hose nozzle as defined in claim 22 wherein said lower conduit part includes an apertured wall facing toward said valve seat in spaced relation thereto, said valve means comprising (1) a valve member including an annular valve element and a valve stem extending therefrom through said aperture wall, and (2) a coil spring surrounding said valve stem between said valve element and said apertured wall.

24. A hose nozzle as defined in claim 23 wherein said female hose fitting comprises a separate member fixed within the lower end of said lower conduit part, said upper conduit part having a pair of side pins extending outwardly thereof at positions near the juncture between said interior barrel and handle portions, said exterior parts having sockets fixedly receiving said pins, lower interior arcuate surfaces fixedly receiving the exterior periphery of said female fitting and forward arcuate surfaces fixedly receiving the exterior periphery of the forward end of said upper conduit part.

25. A hose nozzle as defined in claim 19 wherein means is provided for selectively retaining said trigger member in its operative position.

26. A hose nozzle as defined in claim 25 wherein said trigger retaining means comprises a single trigger retaining member mounted for pivotal movement between an inoperative position and a trigger retaining position, said trigger retaining member including an integral cantilever spring arm arranged so as to resiliently bias said trigger retaining member toward its inoperative position.

27. A hose nozzle as defined in claim 26 wherein said trigger retaining member includes a pair of thumb engaging portions extending outwardly through openings in said exterior parts in positions at opposite sides of the rearward end of said barrel portion.

28. A hose nozzle comprising a handle structure having an exterior periphery shaped to be gripped by a hand of a user, said handle structure including a lower end portion having a female hose fitting therein, a barrel structure extending forwardly from the upper end of said handle structure, means within said handle and barrel structures defining a water flow path extending upwardly from said female hose fitting through said handle structure and forwardly through said barrel structure, means in said water flow path at the forward barrel structure thereof defining a fixed orifice for directing water from the forward end of said barrel structure with a jet stream suitable for sweeping walks and the like, valve means mounted in said flow path upstream from said fixed orifice mounted for movement between valve closing and valve opening positions, a manually engagable member mounted for movement with respect to said handle structure from an inoperative position into an operative position, means for effecting a movement of said valve means from said valve closing position into said valve opening position in response to a manual movement of said manually engagable member from said inoperative position into said operation position, an adjustable spray assembly selectively detachably mountable on said barrel structure downsteam of said fixed orifice defining means in water receiving relation with respect to the water flowing from said fixed orifice defining means for directing the water flowing therefrom in any selected one of a multiplicity of different spray streams so that the user may select as the water output of the hose nozzle either the jet stream flowing from said fixed orifice defining means by detaching said adjustable spray assembly from said barrel structure or the selected spray stream flowing from said adjustable spray assembly by detachably mounting the latter on said barrel structure.

29. A hose nozzle as defined in claim 28 wherein said adjustable spray assembly comprises one of a series of different outlet assemblies, detachable interengaging coupling means on each of said outlet assemblies and said barrel structure fo enabling a user to detachably interconnect a selected one of said set of different outlet assemblies on said barrel structure in flow receiving relation to the water outlet therein so that water flowing from said water outlet will be caused to flow in a stream determined by the selected interconnected outlet assembly.

30. A hose nozzle as defined in claim 29 wherein said detachable interengaging coupling means on said barrel structure includes a shallow frustoconical interior sealing surface within the forward end of said barrel structure and means mounting an O-ring seal in the interior periphery of said barrel structure at a position between the outer extremity thereof and said frustoconical surface, said O-ring having a substantial portion of its interior periphery extending inwardly of the adjacent interior frustoconical surface within said barrel structure and inwardly facing cam surface means within said barrel structure outwardly of said O-ring, each of said outlet assemblies including a tubular coupling portion extending rearwardly therefrom for engaging rearwardly within the forward end of said barrel structure, each tubular coupling portion having an exterior frustoconical surface of a size and shape to be moved rearwardly into engaged sealing relation to the interior frustoconical surface of said barrel structure, an exterior annular groove disposed forwardly of said exterior frustoconical surface for receiving the interior periphery of said O-ring when said frustoconical sealing surfaces are in engagement and rearwardly facing cam surface means disposed forwardly of said annular groove for engaging the forwardly facing cam surface means on said barrel structure when said O-ring is disposed in said groove operable in response to a turning movement of said tubular coupling portion with respect to said barrel structure to cam the tubular coupling portion forwardly with respect to said barrel structure so as to displace said O-ring from within said groove.

31. A hose nozzle as defined in claim 29 wherein a second outlet assembly of said series comprises a rotary outlet assembly, said rotary outlet assembly including a housing assembly having a rearwardly extending tubular portion carrying said coupling means and defining an inlet, said housing assembly having a fixed annular wall providing an interior periphery defining an annular forwardly opening water outlet, speed reducing means within said housing assembly having an input shaft, an output shaft extending forwardly through said outlet in a fixed position of rotational movement and a series of meshing speed reducing gears between said shafts whereby said output shaft is rotated at a speed less than the speed of the input shaft, impeller means drivingly associated with said input shaft and mounted within said housing assembly in a position to be rotated by water under pressure flowing from said inlet to said outlet, a rotary water distributor fixed to said output shaft and disposed in water communicating relation with said outlet, said rotary water distributor including a rearwardly facing annular sealing surface, an annular member mounted for axial movement within said annular water outlet and in surrounding relation with said output shaft, said annular member having an exterior periphery disposed within the interior periphery of said fixed annular wall, an O-ring seal sealingly mounted between the exterior periphery of said annular member and the interior periphery of said fixed annular wall in such a way as to accommodate any relative axial movement of said annular member with respect to said fixed annular wall, means on said annular member defining a forwardly facing sealing surface for sealingly engaging the rearwardly facing sealing surface of said rotary water distributor, spring means acting between said housing assembly and said annular member for resiliently urging the latter forwardly so as to maintain said forwardly facing sealing surface in sealing engagement with the rearwardly facing sealing surface of said rotary water distributor, said housing assembly providing interior flow directing surfaces for directing the water therein to flow from said impeller means and then upwardly between said output shaft and said annular member into communicating relation to rotary water distributor.

32. A hose nozzle comprising a handle structure having an exterior periphery shaped to be gripped by a hand of a user, said handle structure including a lower end portion having a female hose fitting therein, a barrel structure extending forwardly from the upper end of said handle structure, water outlet means at the forward end of said barrel structure, means within said handle and barrel structure defining a waterflow path extending upwardly from said female hose fitting through said handle structure and forwardly to said water outlet means through said barrel structure, valve means mounted in said flow path for movement between valve closing and valve opening positions, a manually engagable member mounted for movement with respect to said handle structure from an inoperative position into an operative position, means for effecting a movement of said valve means from said valve closing position into said valve opening position in response to a manual movement of said manually engagable member from said inoperative position into said operative position, a series of different outlet assemblies, and detachable interengaging coupling means on each of said outlet assemblies and said barrel structure for enabling a user to detachably interconnect a selected one of said set of different outlet assemblies on said barrel structure in flow receiving relation to the water outlet therein so that water flowing from said water outlet means will be caused to flow in a stream determined by the selected interconnected outlet assembly.

33. A hose nozzle as defined in claim 32 wherein said detachable interengaging coupling means on said barrel structure includes a shallow frustoconical interior sealing surface within the forward end of said barrel structure and means mounting an O-ring seal in the interior periphery of said barrel structure at a position between the outer extremity thereof and said frustoconical surface, said O-ring having a substantial portion of its interior periphery extending inwardly of the adjacent interior frustoconical surface within said barrel structure and inwardly facing cam surface means within said barrel structure outwardly of said O-ring, each of said outlet assemblies including a tubular coupling portion extending rearwardly therefrom for engaging rearwardly within the forward end of said barrel structure, each tubular coupling portion having an exterior frustoconical surface of a size and shape to be moved rearwardly into engaged sealing relation to the interior frustoconical surface of said barrel structure, an exterior annular groove disposed forwardly of said exterior frustoconical surface for receiving the interior periphery of said O-ring when said frustoconical sealing surfaces are in engagement and rearwardly facing cam surface means disposed forwardly of said annular groove for engaging the forwardly facing cam surface means on said barrel structure when said O-ring is disposed in said groove operable in response to a turning movement of said tubular coupling portion with respect to said barrel structure to cam the tubular coupling portion forwardly with respect to said barrel structure so as to displace said O-ring from within said groove.

34. A hose nozzle as defined in claim 32 wherein one outlet assembly of said series comprises a rotary outlet assembly, said rotary outlet assembly including a housing assembly having a rearwardly extending tubular portion carrying said coupling means and defining an inlet, said housing assembly having a fixed annular wall providing an interior periphery defining an annular forwardly opening water outlet, speed reducing means within said housing assembly having an input shaft, an output shaft extending forwardly through said outlet in a fixed position of rotational movement and a series of meshing speed reducing gears between said shafts whereby said output shaft is rotated at a speed less than the speed of the input shaft, impeller means drivingly associated with said input shaft and mounted within said housing assembly in a position to be rotated by water under pressure flowing from said inlet to said outlet, a rotary water distributor fixed to said output shaft and disposed in water communicating relation with said outlet, said rotary water distributor including a rearwardly facing annular sealing surface, an annular member mounted for axial movement within said annular water outlet and in surrounding relation with said output shaft, said annular member having an exterior periphery disposed within the interior periphery of said fixed annular wall, an O-ring seal sealingly mounted between the exterior periphery of said annular member and the interior periphery of said fixed annular wall in such a way as to accommodate any relative axial movement of said annular member with respect to said fixed annular wall, means on said annular member defining a forwardly facing sealing surface for sealingly engaging the rearwardly facing sealing surface of said rotary water distributor, spring means acting between said housing assembly and said annular member for resiliently urging the latter forwardly so as to maintain said forwardly facing sealing surface in sealing engagement with the rearwardly facing sealing surface of said rotary water distributor, said housing assembly providing interior flow directing surfaces for directing the water therein to flow from said impeller means and then upwardly between said output shaft and said annular member into communicating relation to rotary water distributor.

35. A rotary output assembly for a hose nozzle or the like comprising a housing assembly having rearwardly extending coupling means for detachably interengaging cooperative coupling means on a hose nozzle or the like, said coupling means defining a water inlet for receiving water from the hose nozzle or the like into the housing assembly, said housing assembly having a fixed annular wall providing an interior periphery defining an annular forwardly opening water outlet, speed reducing means within said housing assembly having an input shaft, an output shaft extending forwardly through said outlet in a fixed position of rotational movement and a series of meshing speed reducing gears between said shafts whereby said output shaft is rotated at a speed less than the speed of the input shaft, impeller means drivingly associated with said input shaft and mounted within said housing assembly in a position to be rotated by water under pressure flowing from said inlet to said outlet, a rotary water distributor fixed to said output shaft and disposed in water communicating relation with said outlet, said rotary water distributor including a rearwardly facing annular sealing surface, an annular member mounted for axial movement within said annular water outlet and in surrounding relation with said output shaft, said annular member having an exterior periphery disposed within the interior periphery of said fixed annular wall, an O-ring seal sealingly mounted between the exterior periphery of said annular member and the interior periphery of said fixed annular wall in such a way as to accommodate any relative axial movement of said annular member with respect to said fixed annular wall, means on said annular member defining a forwardly facing sealing surface for sealingly engaging the rearwardly facing sealing surface of said rotary water distributor, spring means acting between said housing assembly and said annular member for resiliently urging the latter forwardly so as to maintain said forwardly facing sealing surface in sealing engagement with the rearwardly facing sealing surface of said rotary water distrubutor, said housing assembly providing interior flow directing surfaces for directing the water therein to flow from said impeller means and then upwardly between said output shaft and said annular member into communicating relation to rotary water distributor.

36. A rotary output assembly as defined in claim 35 wherein said rotary distributor comprises a rotary head member defining a series of inner outlet orifices and a series of outer outlet orifices.

* * * * *